US007146774B2

(12) United States Patent
Fredette

(10) Patent No.: US 7,146,774 B2
(45) Date of Patent: Dec. 12, 2006

(54) OVERLAPPING CORNER PIECE FOR SIDING RETAINERS

(76) Inventor: Richard Fredette, 625 Hector Connoly Rd. P.O. Box 213, Carencro, LA (US) 70520

( * ) Notice: Subject to any disclaimer, the term of this patent is extended or adjusted under 35 U.S.C. 154(b) by 0 days.

(21) Appl. No.: 10/839,588

(22) Filed: May 5, 2004

(65) Prior Publication Data

US 2004/0221541 A1 Nov. 11, 2004

Related U.S. Application Data

(63) Continuation-in-part of application No. 10/429,574, filed on May 5, 2003, now abandoned.

(51) Int. Cl.
*E04C 2/38* (2006.01)

(52) U.S. Cl. ..... 52/656.6; 52/656.9; 52/717.01; 52/204.53

(58) Field of Classification Search ..... 52/656.1, 52/656.5, 656.6, 656.4, 656.9, 717.01, 204.53; 248/220.1; 403/401–403, 286, 405.1, 295, 403/296

See application file for complete search history.

(56) References Cited

U.S. PATENT DOCUMENTS 3,866,380 A * 2/1975 Benson ..... 52/656.6
4,222,209 A * 9/1980 Peterson ..... 52/172
4,608,800 A * 9/1986 Fredette ..... 52/656.1
5,671,580 A * 9/1997 Chou ..... 52/656.4
5,921,056 A * 7/1999 Weiss et al. ..... 52/745.16
5,924,259 A * 7/1999 Marousek ..... 52/656.1

* cited by examiner

*Primary Examiner*—Naoko Slack
*Assistant Examiner*—Chi Q. Nguyen
(74) *Attorney, Agent, or Firm*—Ted M. Anthony

(57) ABSTRACT

Applicant's invention comprises a corner piece which is firmly attached to a wall at a juncture of horizontal and vertical retainer strips and covers the juncture between the horizontal and vertical retainer strips, providing a barrier to direct water and/or moisture from invading behind such horizontal and vertical retainer strips. The invention comprises a generally L-shaped base plate and integrally formed first and second flange means extending outward and parallel thereto to provide a continuous L-shaped barrier that forms a channel which cooperates with and contains the ends of the vertical and horizontal retainer strips adjacent the corner of the opening, and flaps which cover seams formed between such retainer strips and the corner piece in the channels.

8 Claims, 9 Drawing Sheets

"PRIOR ART"

"PRIOR ART"

OVERLAPPING CORNER PIECE FOR SIDING RETAINERS

CROSS REFERENCES TO RELATED APPLICATIONS

This is a continuation-in-part of application Ser. No. 10/429,574, filed May 5, 2003, currently abandoned.

STATEMENTS AS TO RIGHTS TO INVENTIONS MADE UNDER FEDERALLY SPONSORED RESEARCH AND DEVELOPMENT

NONE

BACKGROUND OF THE INVENTION

1. Field of the Invention

The present invention relates to siding for covering walls of structures. More particularly, the present invention relates to an overlapping corner piece for covering the junctions between horizontal and vertical siding retainer strips installed around right-angled openings. More particularly still, the present invention relates to a versatile overlapping corner piece which protects against intrusion of rain water and other moisture behind said siding retainer strips.

2. Description of the Prior Art

Siding, such as vinyl and aluminum siding and the like, is typically attached to a wall of a structure, generally an exterior wall, by affixing a pair of parallel retaining strips to said wall. Such retaining strips generally contain longitudinal slots in which hooks protruding from the back surface of the siding can be placed. Wall openings frequently present problems during the siding installation process. This is especially true for openings having right angles, such as doors or windows, because such openings have both horizontal and vertical frame components.

When siding is installed around wall openings having right angles, siding retaining strips are typically placed adjacent to the horizontal and vertical frame components of said openings. Such siding retaining strips are essentially channel-shaped, and are comprised of a flat base which is attached to the wall, and an outwardly projecting L-shaped member that provides a channel into which the siding is placed. The junction between horizontal and vertical strips at or near a corner of a wall opening, such as a door or window, creates a visible separation which detracts from the appearance of the siding. The junction between such retainer strips can become even more noticeable as temperatures changes, and the siding expands or contracts. The junction also creates functional problems by permitting rain, snow or other moisture to invade the area behind such retainer strips.

A prior art corner piece has been developed for use on junctions between adjacent horizontal and vertical retainer strips. The subject corner piece comprises a generally L-shaped base plate having a first leg integral with the second leg; said first and second legs being defined by inner and outer edges. A first and a second flange extend outwardly from the plate continuously along the inner edges of the first and second legs, the flanges being comprised of first and second members. The first member is perpendicular to the plate, while the second member is held in spaced, substantially parallel relationship to the base plate by the first member. The second members thereby present a continuous, L-shaped barrier that forms a channel in cooperation with the base plate and first member.

The corner piece is placed at the corner of a door or window around which siding is being installed. A first retainer strip is placed adjacent the horizontal frame component along substantially its entire length, with the channel of the first strip being placed within the channel of a first leg of the base plate. A second retaining strip is placed adjacent the vertical frame component along substantially the entire length of the vertical frame component with the channel of the second strip being received within the channel of a second leg of the base plate. In this manner, the visible junction between horizontal and vertical retainer strips is obscured.

When the channels of said retainer strips are received within the channels of said first and second legs of the base plate of a corner piece as described above, said retainer strips extend into, and partially overlap, the channels of said corner piece base plate. The corner piece spans the gap formed at the junction between said horizontal and vertical retainer strips. Moreover, said corner piece provides a barrier for preventing water from getting behind such retainer strips. However, this barrier does not stop all water from invading the area behind the retainer strips.

As a result of the overlapping relationship, seams are created between said retainer strips and the legs of said corner piece base plates. Although the corner pieces prevent much of the water from going behind the components, the seams nonetheless provide entry points for water or moisture to invade behind such retainer strips and/or corner pieces. This is especially true with retainer strips placed adjacent to vertical frame components, because gravity can cause water and/or moisture entering such seams to invade into any open void areas (such as cracks, crevices and interstices) existing behind such retainer strips.

In many cases, siding is installed on structures to protect such structures from the elements, such as wind and rain. As such, invasion of water and/or moisture into the areas behind siding in general, and retainer strips in particular, can result in a number of problems. Such water and/or moisture can lead to rotting and decay of the underlying material(s) supporting the siding and retainer strips. Accordingly, it is desirable to have a siding corner piece which can prevent water or moisture from invading into the areas behind siding and siding retainer strips.

It is accordingly an object of this invention to provide a corner piece for covering junctions between adjacent horizontal and vertical siding retainer strips, which will prevent invasion of water and/or moisture into areas behind such retainer strips.

SUMMARY OF THE INVENTION

The foregoing objects are achieved by providing a corner piece for covering junctions formed between adjacent horizontal and vertical siding retainer strips. The corner piece of the present invention comprises a generally L-shaped base plate having a first leg integral with a second leg, the first leg being defined by an inner and an outer edge, the second leg also being defined by an inner and an outer edge. First and second flanges extend outwardly from said base plate continuously along the inner edges of the first and second legs, respectively. Said flanges are comprised of first and second members. The first member of each flange is perpendicular to the base plate, while the second member of each flange is held in spaced, substantially parallel relationship to said base plate by the corresponding first member. Said second members thereby present a continuous, L-shaped barrier that forms a channel in cooperation with the base plate and said first members.

Said first members, which are in perpendicular relationship to the first and second legs of said base plate, each contain a flap having a secured end and a free end. The secured end of each flap is affixed or otherwise joined to its corresponding first member in general proximity to the junction between said first and second legs. Although it is possible that said flaps could be constructed of separate pieces of material attached to the upper surfaces of said first members, in the preferred embodiment of the present invention said flaps are integrally formed from said first members. Specifically, in the preferred embodiment, said flaps are formed by a three-sided groove in each of said first members. A utility knife or other sharp object can be used to cut three sides of said flaps along such grooves, thereby allowing said flaps to bend away from said first members.

In one embodiment of the present invention, an additional groove is disposed along the first members of said corner piece. In the preferred embodiment, said groove is situated in proximity to said base plate and extends substantially along the entire length of said corner piece. A utility knife or other sharp object can be used to cut along said groove in order to easily and effectively remove said base plate. In certain situations, installation of the corner piece of the present invention is improved by removing said base plate.

The corner piece is placed at the corner of a door or window around which siding is being installed. A first retainer strip is placed adjacent to the horizontal component along substantially its entire length; the channel of the first strip is placed within the channel of a first leg of the base plate, and inserted under the flap on the first member of said leg. A second retaining strip is placed adjacent the vertical frame component along substantially the entire length of the vertical frame component; the channel of the second strip is received within the channel of a second leg of the base plate, and inserted under the flap on the first member of said leg. In this member, the visible junction between horizontal and vertical retainer strips is obscured. Further, the flap corresponding to the first leg of the base plate covers the seam formed between the horizontal retainer strip and said first leg of the base plate. Similarly, the flap corresponding to the second leg of the base plate covers the seam formed at the junction between the vertical retainer strip and said second leg of said base plate. In particular situations where it is warranted, the base plate can be removed from said corner piece prior to installation.

DETAILED DESCRIPTION OF THE PRESENT INVENTION

Figure 1:
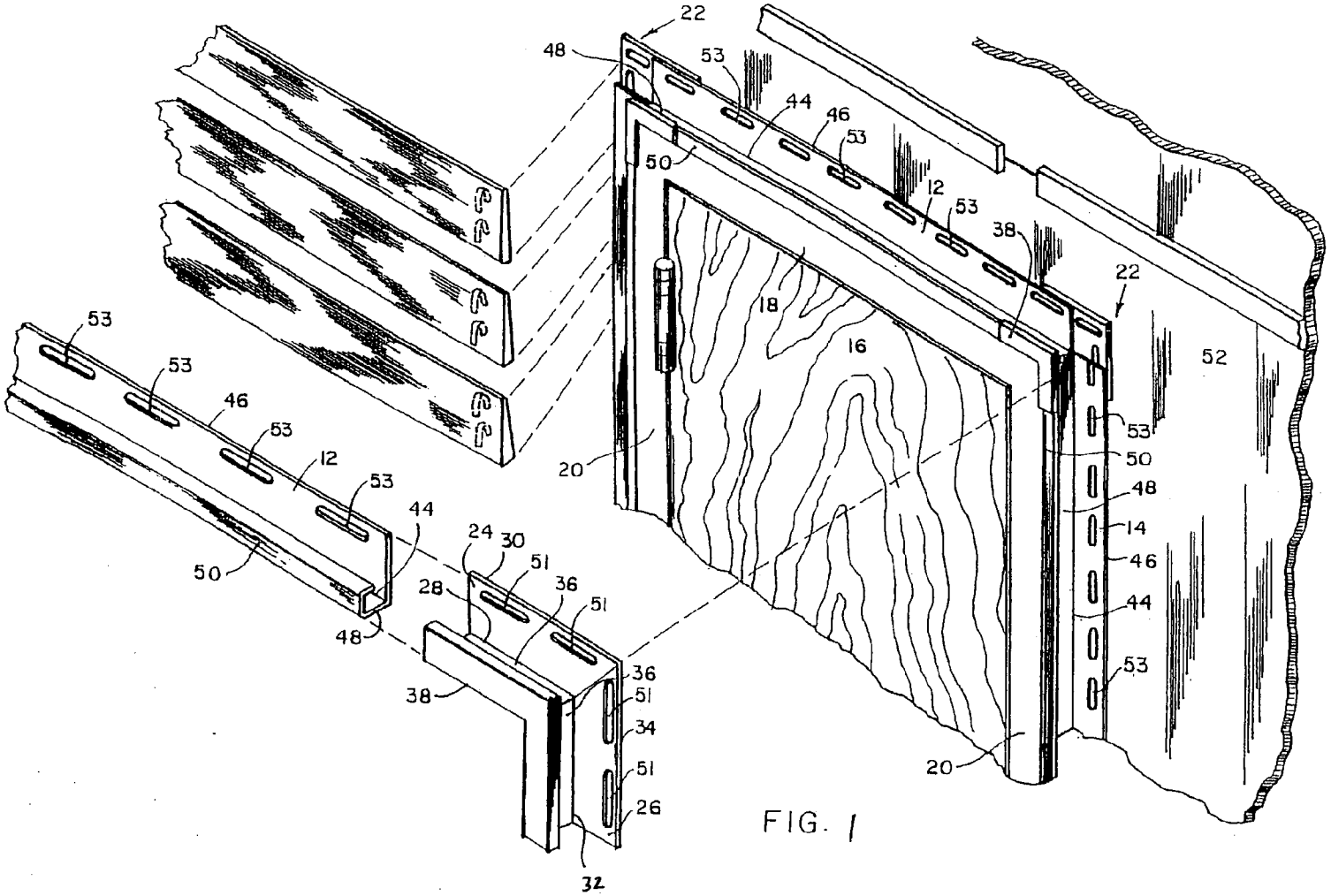
FIG. 1 is a perspective, fragmentary view of a corner piece covering the junction between adjacent horizontal and vertical retainer strips.

Referring to the drawings, FIG. 1 is a perspective, fragmentary view of a corner piece covering the junction between adjacent horizontal and vertical retainer strips. A vinyl corner piece 10 is shown for covering junctions between adjacent horizontal retainer strip 12 and vertical retainer strip 14. Retainer strips 12 and 14 are of the kind known in the art for retaining siding around right-angled openings such as door 16 having a horizontal frame component 18 and a vertical frame component 20. Corner piece 10 comprises a generally L-shaped vinyl base plate 22 having a first leg 24 integral with a second leg 26. First leg 24 is defined by an inner edge 28 and an outer edge 30. Second leg 26 is also defined by an inner edge 32 and an outer edge 34.

First and second vinyl flanges extend outwardly from base plate 22 continuously along inner edges 28 of first leg 24 and inner edge 32 of second leg 26. Each flange is comprised of a first member 36 and a second member 38. First member 36 is formed integral with second member 38, the first member 36 of each flange being perpendicular to base plate 22. Flaps 60, obscured from view in FIG. 1, are located on the first member 36 of each flange. Second member 38 of each flange is held in spaced, substantially parallel relationship to base plate 22 by first member 36, said second member 38 presenting a continuously, L-shaped barrier that forms a channel in cooperation with base plate 22 and first member 36 of each flange.

Figure 2:
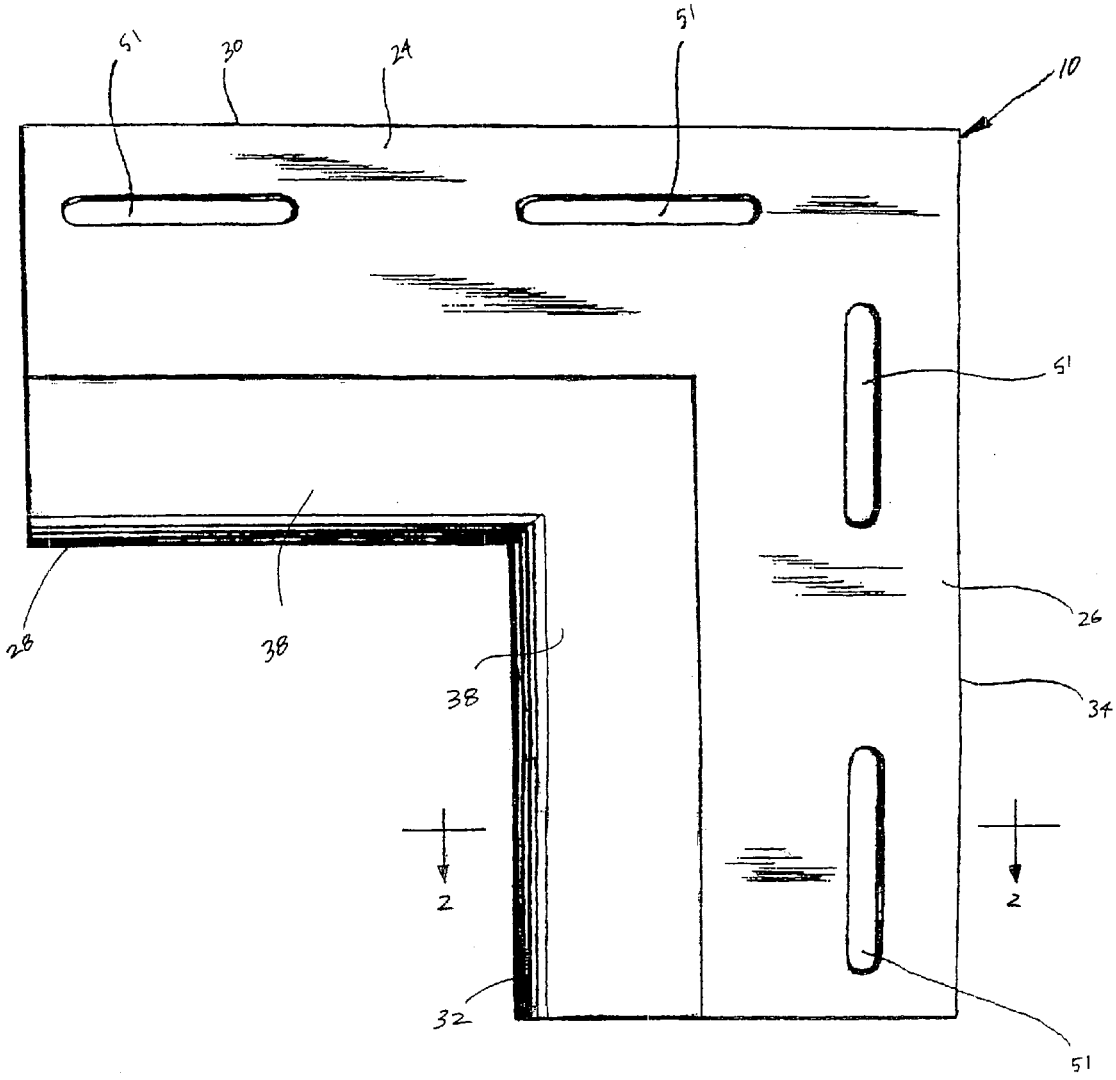
FIG. 2 is a plan view of the corner piece for covering junctions between adjacent horizontal and vertical retainer strips.

FIG. 2 depicts a plan view of corner piece 10. Corner piece 10 comprises a generally L-shaped vinyl base plate 22 having a first leg 24 integral with a second leg 26. First leg 24 is defined by an inner edge 28 and an outer edge 30, while second leg 26 is also defined by an inner edge 32 and an outer edge 34. First and second vinyl flanges extend outwardly from base plate 22 continuously along inner edges 28 and 32 of first and second legs 24 and 26, respectively. Each flange is comprised of a first member 36 and a second member 38. Although obscured from view in FIG. 2, first member 36 is formed integral with second member 38, said first member 36 being perpendicular to base plate 22. Second member 38 is held in spaced, substantially parallel relationship to base plate 22 by first member 36.

Figure 3:
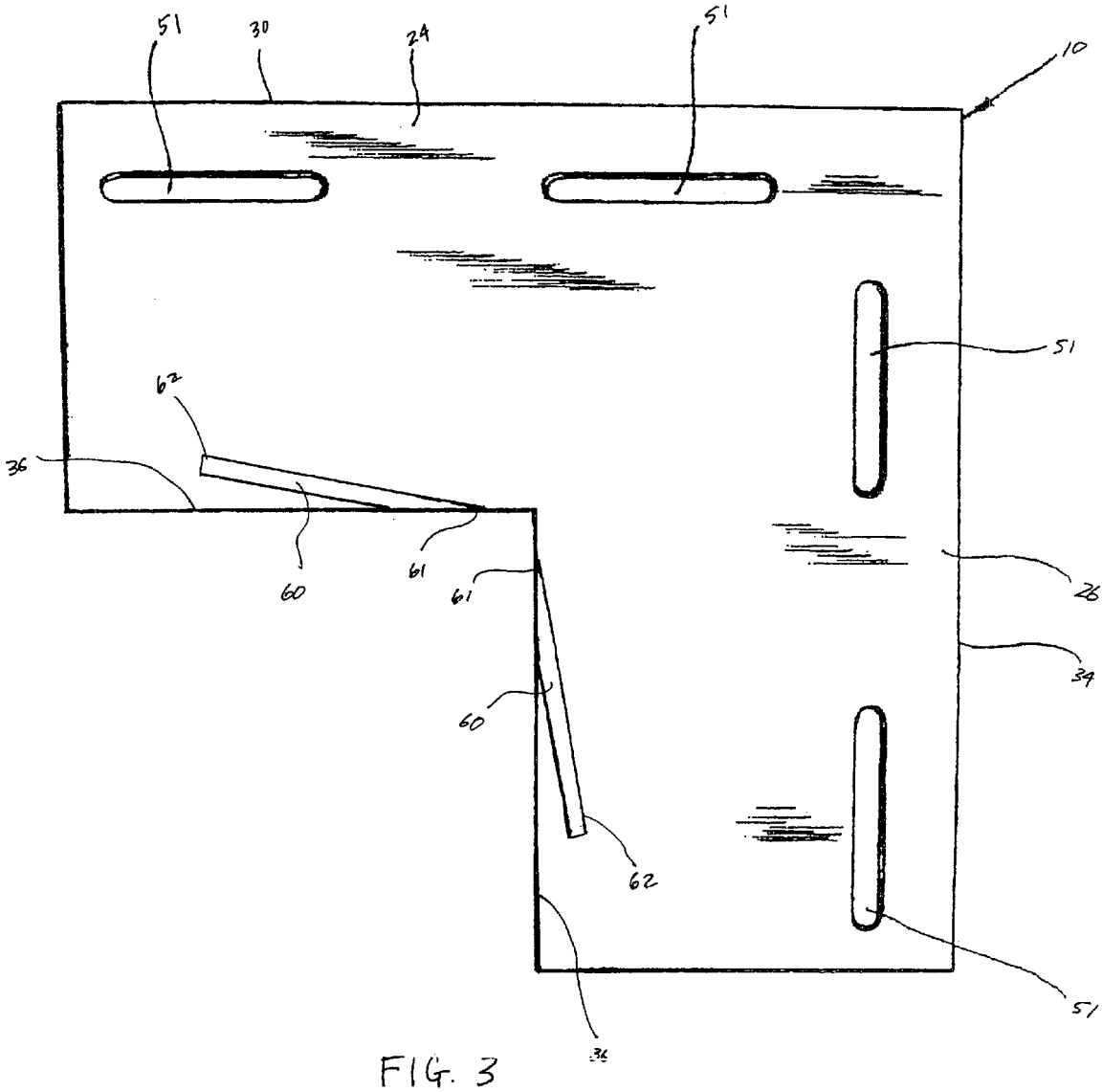
FIG. 3 is a partial cut away plan view of the corner piece depicted in FIG. 2, with an outer flange member removed to illustrate flaps.

FIG. 3 is a plan view of the corner piece depicted in FIG. 2, with second member 38 from said flanges removed for the purpose of allowing flaps 60 to be visible from this view. Flaps 60 are shown originating from first members 36 which extend in perpendicular direction from base plate 22. Although it is possible that flaps 60 could be constructed of separate planar members partially affixed to said first members 36, in the preferred embodiment flaps 60 are partial cut-outs of said first members 36. Said flaps 60 are formed by three-sided grooves in said first members. A utility knife or other sharp object can be used to cut along said three-sided grooves, thereby releasing said flaps 60, which each have secured end 61 and free end 62. In the preferred embodiment, once cut, free end 62 can be lifted away from first member 36. Because corner piece 10 is constructed of vinyl or other flexible material, flap 60 hinges at secured end 61, allowing free end 62 to travel away from first member 36.

Figure 4:
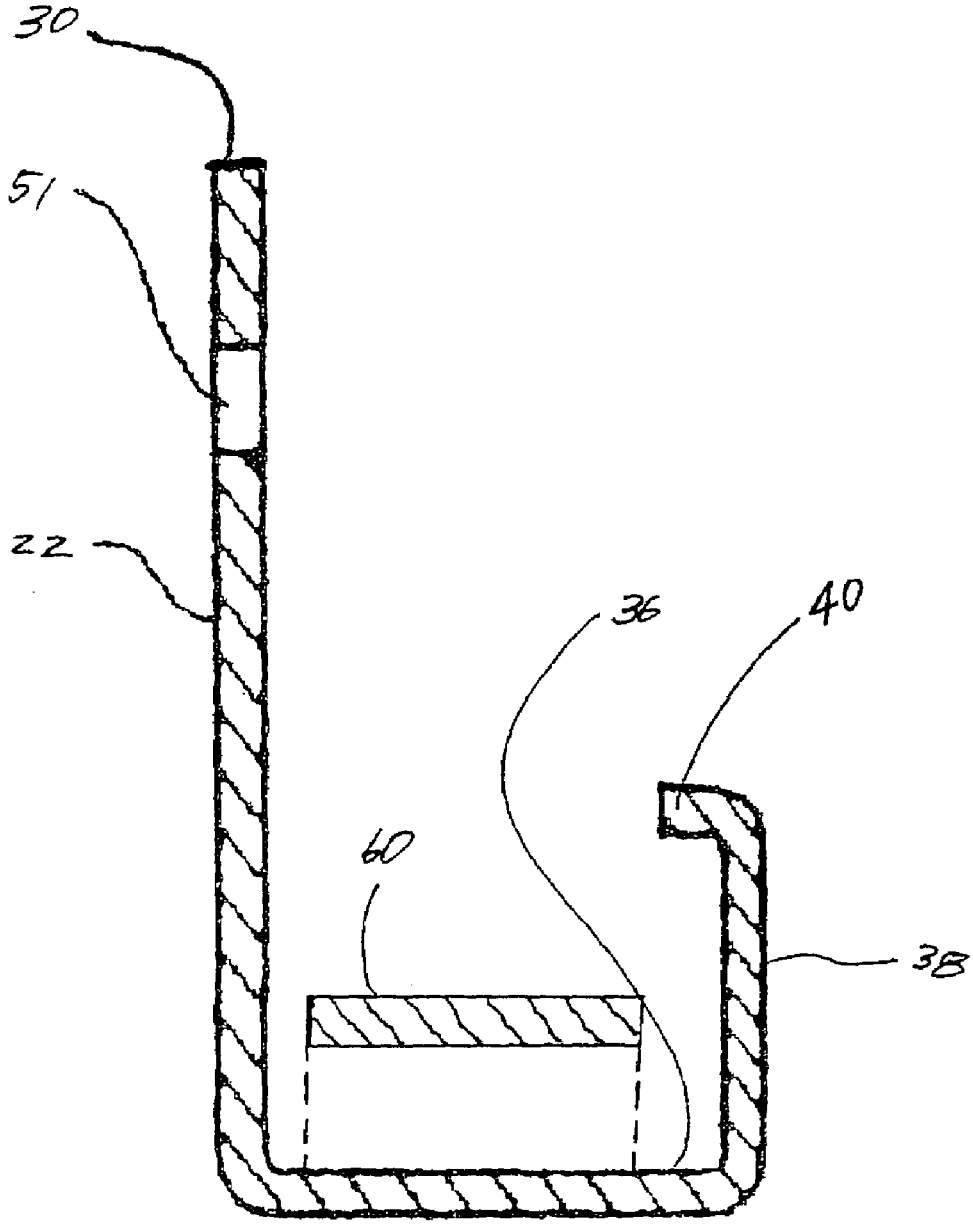
FIG. 4 is a cross-sectional view taken along section lines 2—2 in FIG. 2.

FIG. 4 depicts a cross-sectional view taken along section lines 2—2 of FIG. 2. Flanges extend outwardly from base plate 22 continuously along inner edges 32 of second leg 26. Each flange is comprised of a first member 36 and a second member 38. First member 36 is formed integral with second member 38, the first member 36 being perpendicular to base plate 22. Flap 60 is located on first member 36 and is depicted as being cut away from said first member; the body of said flap 60 near free end 61 is depicted as being lifted away from first member 36. Second member 38 is held in spaced, substantially parallel relationship to base plate 22 by first member 36, the second member 38 presenting a barrier that forms a channel in cooperation with base plate 22 and first member 36.

Still referring to FIG. 4, a continuous vinyl retainer lip flange 40 is integral with and carried by each second member 38 and projects from second member 38 toward base plate 22 in at least partially covering relationship to the channel formed by base plate 22, first member 36 and second member 38. In the embodiment shown in the drawings, retainer flange 40 is an arcuate member which is in covering relationship to only a portion of the channel formed by corner piece 10 and substantially parallel to first member 36 that it covers. The purpose of retainer flange 40 is to press siding into close relationship with base plate 22.

Figure 5:
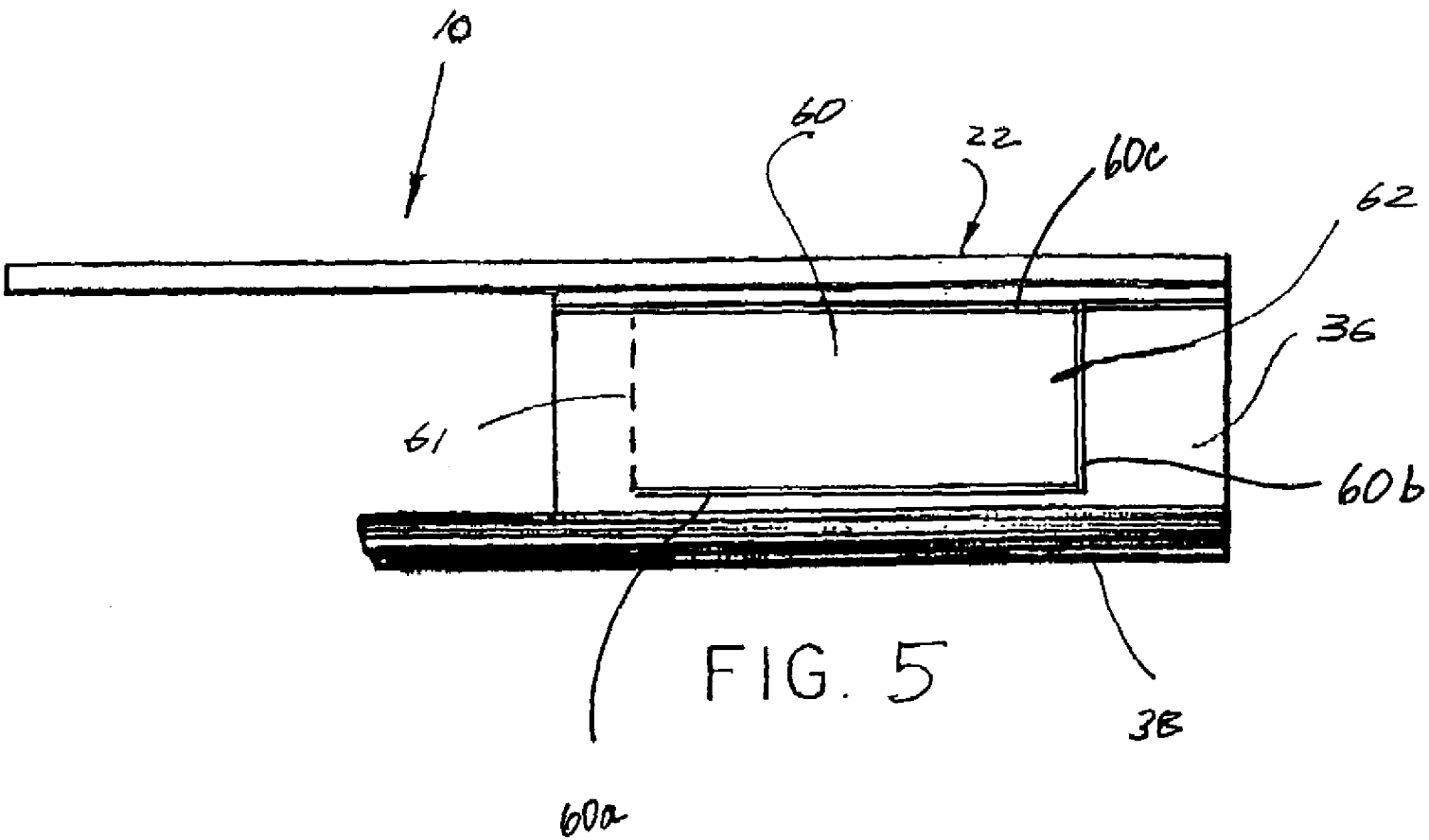
FIG. 5 is a side view of the corner piece shown in FIG. 2, the view being taken into the channel of the corner piece.

FIG. 5 is a side view of the corner piece depicted in FIG. 2, the view being taken into the channel of said corner piece. A flange extends outwardly from base plate 22 continuously along inner edges 32 of second leg 26. Each flange is comprised of a first member 36 and a second member 38. First member 36 is formed integral with second member 38, the first member 36 being perpendicular to base plate 22. Flap 60 is defined by grooves 60*a*, 60*b* and 60*c*. When said grooves are cut, flap 60 is formed as a partial cut-out of first member 36. The body of said flap 60 is cut from first member 36 along three sides of said flap 60; the remaining side of flap 60, at secured end 61, is not cut through said first member 36. Because said first member 36 (and, ideally, all of corner piece 10) is constructed of flexible material, such as vinyl, secured end 61 acts as a hinge allowing free end 62 of flap 60 to lift away from first member 36. In the preferred embodiment, groove 60*c* actually extends substantially along the entire length of said corner piece in general proximity to base plate 22. Second member 38 is held in spaced, substantially parallel relationship to base plate 22 by first member 36, said second member 38 presenting a barrier that forms a channel in cooperation with base plate 22 and first member 36.

Referring back to FIG. 1, retainer strips 12 and 14 are each defined by a first edge 44 and second edge 46, the strips preferably being made of vinyl or other material similar to the siding being installed. An L-shaped extension projects outwardly from each strip 12 and 14 along first edge 44 of strip 12 and 14. The extension is comprised of first element 48 and second element 50, the elements being integral with strip 12 and 14. First element 48 is substantially perpendicular to the strip 12 and 14, the second element 50 being held in spaced, parallel relationship to strip 12 or 14 by first element 48. The perpendicular distance between second element 50 and strip 12 or 14 is less than the perpendicular distance between second member 38 of corner piece 10 and its base plate 22, the channel formed by retainer strips 12 and 14 thereby being slightly narrower than the channel formed in corner piece 10. Second element 50 of strips 12 and 14 each present a continuous barrier that forms a channel in cooperation with strip 12 or 14 and first element 48.

Still referring to FIG. 1, the generally L-shaped base plate 22 is secured adjacent a corner formed by the intersection of horizontal and vertical components 18 and 20 of the frame for door 16. Base plate 22 is secured to the corner by driving a nail, screw or other suitable fastener through the base plate and adjoining wall. In the embodiment shown in the drawings, elongated slots 51 are provided in corner piece 10 through which fasteners may be placed. First leg 24 is placed adjacent and parallel to horizontal component 18 of the door frame while second leg 26 is placed adjacent and parallel to the vertical component 14 of the frame. After being so fastened to the wall, base plate 22 is parallel to exterior wall 52 of the structure being covered, while first member 36 projects perpendicularly outwardly away from wall 52 flush with the frame component in which it is adjacent. Second member 38 thereby presents a continuous, L-shaped barrier parallel to base plate 22 around the corner.

Horizontal retainer strip 12 is fixed adjacent to horizontal frame component 18 along substantially the entire length of horizontal frame component 18. First strip 48 is fastened flat against wall 52 with its channel resting along the length of horizontal frame component 18. First element 48 thereby projects perpendicularly outwardly from wall 52 while second element 50 provides a continuous barrier which, in cooperation with the element 48 and strip 12 creates a channel into which siding panels may be received. Fasteners can be placed through slots 53. Because the channel of strip 12 is narrower than the channel of first leg 24, the channel of strip 12 is received within the channel of first leg 24 of corner piece 10.

In the preferred embodiment, the width of channel strip 12 is only slightly less than the width of the channel of corner piece 10, thereby providing a sliding yet tight fit between strip 12 and the channel of first leg 24. Prior to inserting the channel of strip 12 into the channel of the first leg of corner piece 10, grooves 60*a*, 60*b* and 60*c* are cut using a utility knife or other sharp tool, thereby defining flap 60. Free end 62 of flap 60 is lifted away from first member 36. First element 48 of strip 12 is then inserted under flap 60, resulting in flap 60 substantially covering the seam formed at the junction between strip 12 and corner piece 10.

Second strip 14 is affixed to wall 52 adjacent to vertical frame component 20 along substantially the entire length of the vertical frame component by fixing fasteners through openings 53. Strip 14 is flush with the vertical frame component in much the same fashion as described above with the horizontal frame component 18. The channel of the second, vertical strip is once again only slightly smaller than the channel of second leg 26 so that the channel of second, vertical strip 14 is received within the channel of second leg 26 of corner piece 10. Prior to inserting the channel of strip 14 into the channel of the second leg of corner piece 10, free end 62 of flap 60 is lifted away from first member 36. First element 48 of strip 14 is then inserted under flap 60, such that flap 60 substantially covers the seam formed at the junction between strip 14 and corner piece 10.

Figure 6:
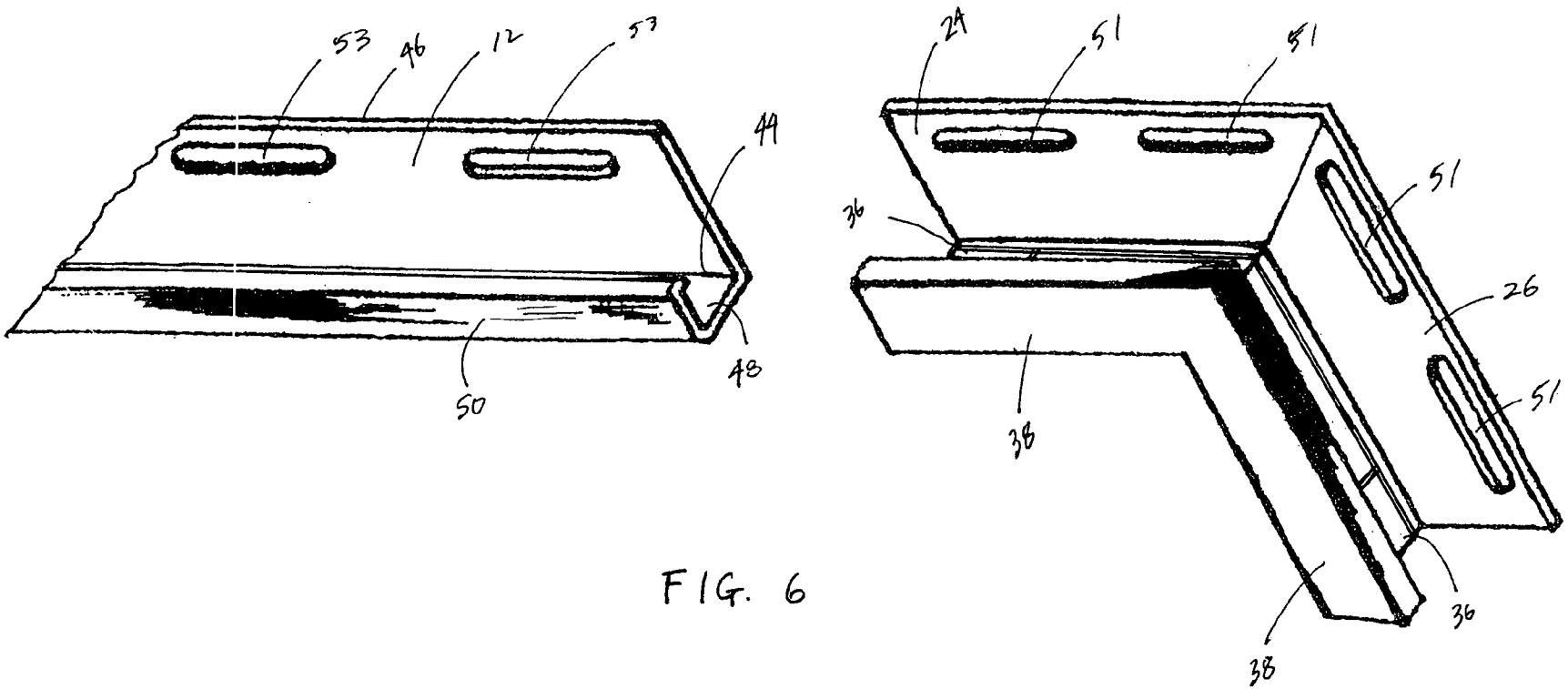
FIG. 6 is a perspective view of corner piece of the present invention and a mating retainer strip.

FIG. 6 depicts a perspective view of corner piece 10 of the present invention, as well as horizontal retainer strip 12. Corner piece 10 comprises a generally L-shaped base plate having a first leg 24 integral with a second leg 26. First leg 24 is defined by an inner edge 28 and an outer edge 30, while second leg 26 is also defined by an inner edge 32 and an outer edge 34. First and second vinyl flanges extend outwardly from base plate 22 continuously along inner edges 28 and 32 of first and second legs 24 and 26, respectively. Each flange is comprised of first member 36 and second member 38. Second member 38 is held in spaced, substantially parallel relationship to base plate 22 by first member 36, the second member 38 forming a channel in cooperation with base plate 22 and first member 38.

Figure 7:
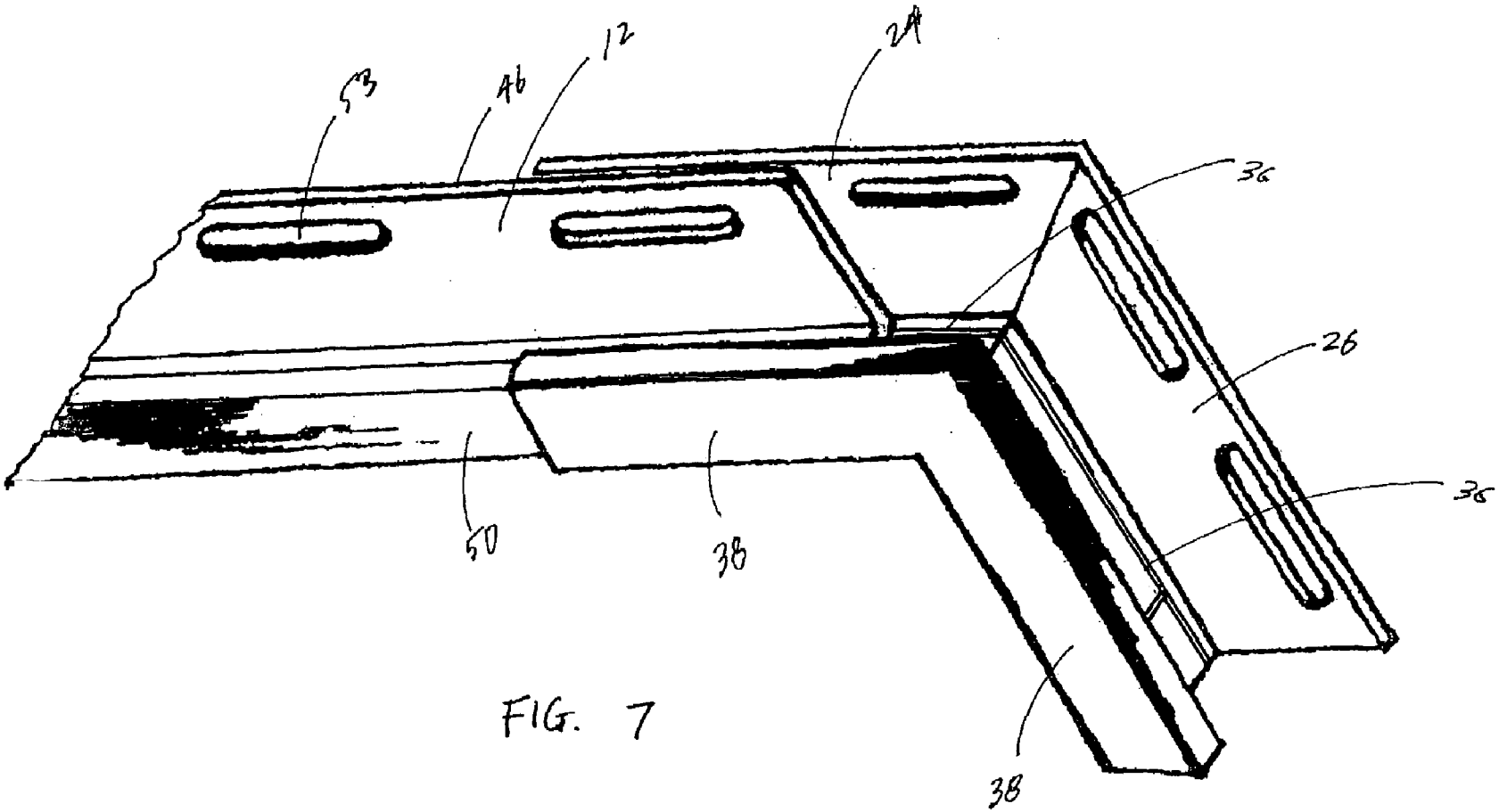
FIG. 7 is a perspective view of a corner piece of the present invention having the channel of a retainer strip received within a channel of said corner piece.

Retainer strip 12 is shown a short distance from corner piece 10, such as when said elements are to be mated during the siding installation process. Referring to FIG. 7, the channel of retainer strip 12 is inserted within the channel of corner piece 10. Because the channel of retainer strip 12 is narrower than the channel of first leg 24 of corner piece 10, the channel of retainer strip 12 is received within the channel of first leg 24 of corner piece 10.

Figure 8:
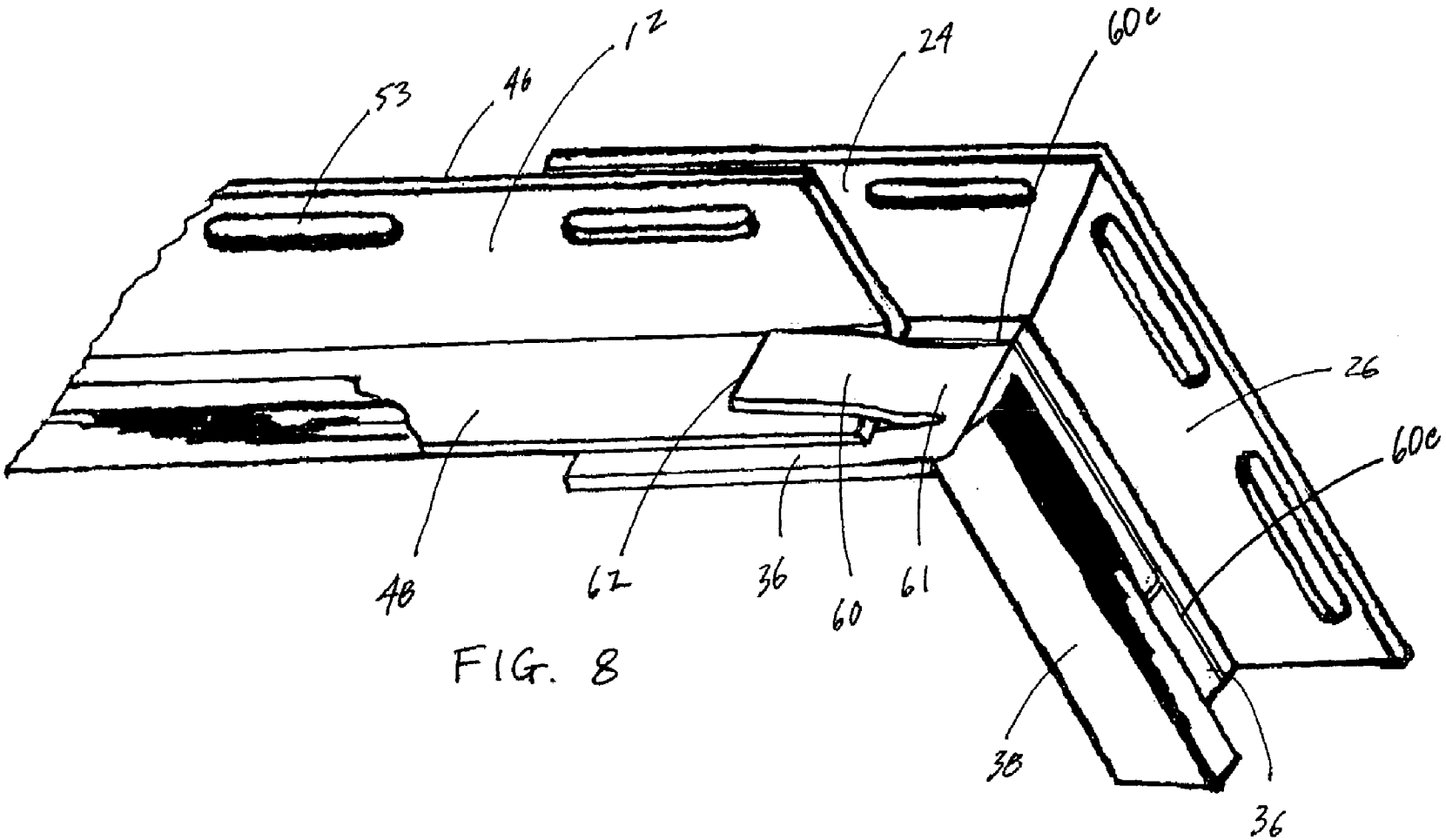
FIG. 8 is a partial cut away view of a corner piece of the present invention depicting a flap covering the seam formed between a retainer strip and said corner piece.

In FIG. 8, a portion of retainer strip 12 and corner piece 10 are cut away to reveal flap 60 which is cut from first member 36 along grooves 60*a*, 60*b* and 60*c* (not shown in FIG. 8). Specifically, when the channel of retainer strip 12 is inserted into the channel of first leg 24 of corner piece 10, free end 62 of flap 60 is raised away from first member 36. First element 48 of retainer strip 12 is then inserted under flap 60. In this manner, flap 60 provides a barrier to prevent rain, moisture and other elements from invading the interface or seam between retainer strip 12 and first leg 24 of corner piece 10. In certain circumstances, it may be preferable to install corner piece 10 without base plate 22. In such instances, base plate 22 can be easily and efficiently removed by cutting along the entire length of groove 60*c* using a utility knife or other sharp object.

Figure 9:
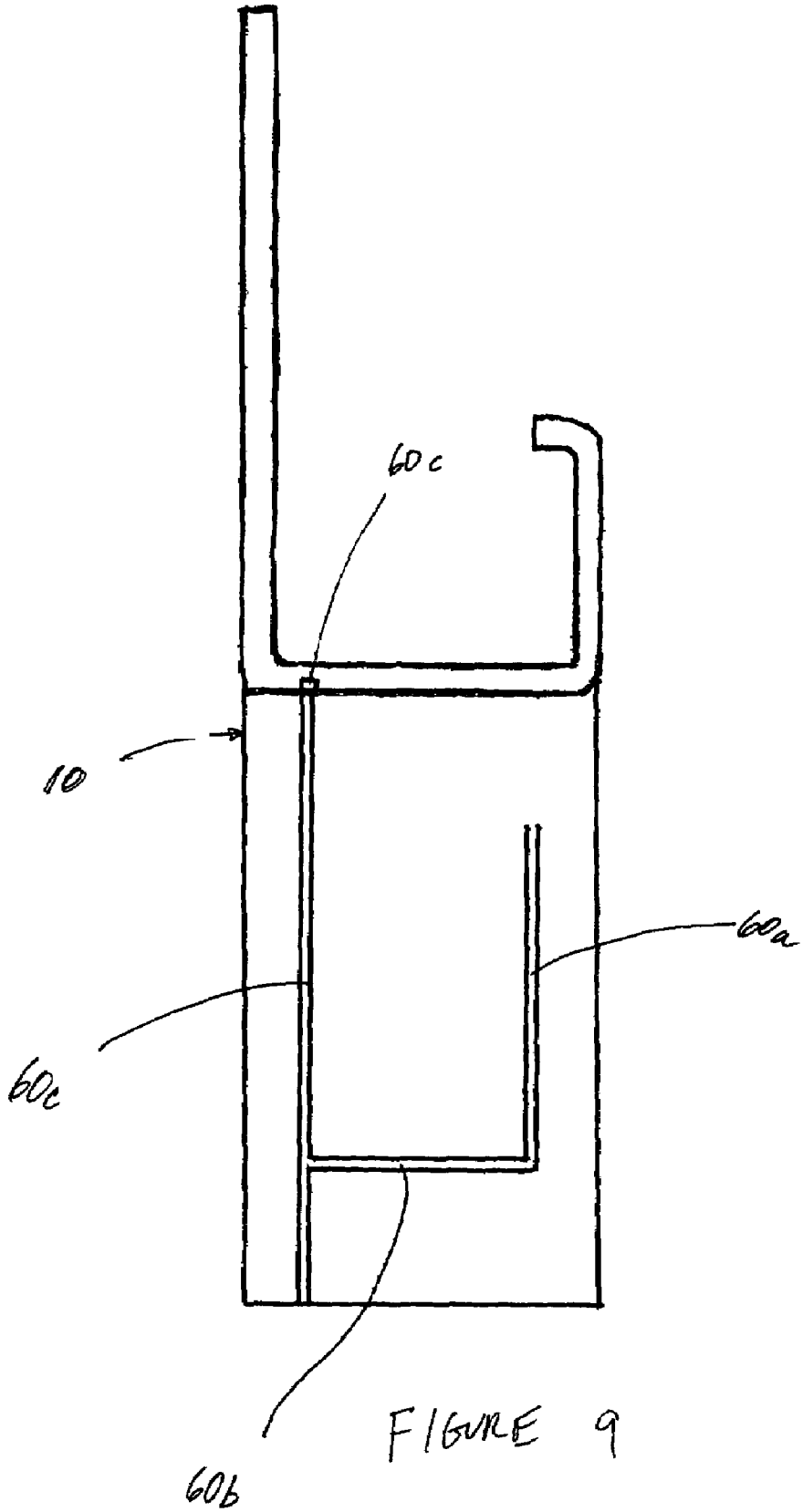
FIG. 9 is an end view of the corner piece of the present invention.

FIG. 9 depicts and end view of another embodiment of corner piece 10. Although the previous discussion describes grooves 60*a*, 60*b* and 60*c* being disposed along the upper surface of first members 36, it is possible that such grooves could be disposed along the lower, or bottom, surfaces of such first members 36. FIG. 9 depicts such grooves disposed along the lower surfaces of first members 36 of corner piece 10.

Although a preferred embodiment of the invention has been disclosed in accordance with requirements of law, the scope of the invention is at least as broad as the following claims.

What is claimed:

1. A corner piece for covering junctions between adjacent horizontal and vertical retainer strips around an opening in a wall, said corner piece comprising:

a) a substantially L-shaped base plate having a first leg and a second leg integrally attached to one another, wherein said first leg has an inner and an outer edge, and said second leg has an inner and an outer edge;

b) a first flange extending from said base plate continuously along the inner edge of said first leg of said base plate, said flange having a first member and a second member, wherein said first member is oriented perpendicular to said base plate, said second member is held in spaced, substantially parallel relationship to said base plate by said first member, and said first and second members form a channel in cooperation with said base plate;

c) a second flange extending from said base plate continuously along the inner edge of said second leg of said base plate, said second flange having a first member and a second member, wherein said first member is oriented perpendicular to said base plate, said second member is held in spaced, substantially parallel relationship to said base plate by said first member, and said first and second members form a channel in cooperation with said base plate;

d) a first flap on said first member of said first flange between said base plate and said second member of said first flange;

e) a second flap on said first member of said second flange between said base plate and said second member of said second flange; and f) a continuous retainer flange carried by each second member and projecting from said second members toward the base plate in partially covering relationship to the channels.

2. The corner piece of claim 1, further comprising a linear groove in said first members of said first and second flanges, wherein said groove extends substantially along the entire length of said first and second flanges.

3. The corner piece of claim 1 further comprising a plurality of apertures extending through said base plate.

4. The corner piece of claim 1 wherein the corner piece is vinyl.

5. A corner piece for covering junctions between adjacent horizontal and vertical retainer strips around an opening in a wall, said corner piece comprising:

a) a substantially L-shaped base plate having a first leg and a second leg integrally attached to one another, wherein said first leg has an inner and an outer edge, and said second leg has an inner and an outer edge;

b) a first flange extending from said base plate continuously along the inner edge of said first leg of said base plate, said flange having a first member and a second member, wherein said first member is oriented perpendicular to said base plate, said second member is held in spaced, substantially parallel relationship to said base plate by said first member, and said first and second members form a channel in cooperation with said base plate;

c) a second flange extending from said base plate continuously along the inner edge of said second leg of said base plate, said second flange having a first member and a second member, wherein said first member is oriented perpendicular to said base plate, said second member is held in spaced, substantially parallel relationship to said base plate by said first member, and said first and second members form a channel in cooperation with said base plate;

d) a first three-sided groove in said first member of said first flange, wherein the first side of said groove extends along one side of said first member in parallel relation to said base plate, the second side of said groove extends across said first member in perpendicular relation to said base plate, and the third side of said groove extends along said first member in parallel relationship to said first side of said groove;

e) a second three-sided groove in said first member of said second flange, wherein the first side of said groove extends along one side of said first member in parallel relation to said base plate, the second side of said groove extends across said first member in perpendicular relation to said base plate, and the third side of said groove extends alone said first member in parallel relationship to said first side of said groove; and f) a continuous retainer flange carried by each second member and projecting from said second members toward the base plate in partially covering relationship to the channels.

6. The corner piece of claim 5, further comprising a linear groove extending along the length of said first member of said first flange and said first member of said second flange, wherein said groove passes through the first sides of said first and second three-sided grooves.

7. The corner piece of claim 5 further comprising a plurality of apertures extending through said base plate.

8. The corner piece of claim 5 wherein the corner piece is vinyl.

* * * * *